US006501055B2

(12) United States Patent
Rock et al.

(10) Patent No.: US 6,501,055 B2
(45) Date of Patent: Dec. 31, 2002

(54) ELECTRIC HEATING/WARMING FABRIC ARTICLES

(75) Inventors: Moshe Rock, Andover, MA (US); Vikram Sharma, Stoneham, MA (US)

(73) Assignee: Malden Mills Industries, Inc., Lawrence, MA (US)

( * ) Notice: Subject to any disclaimer, the term of this patent is extended or adjusted under 35 U.S.C. 154(b) by 0 days.

(21) Appl. No.: 09/814,896

(22) Filed: Mar. 22, 2001

(65) Prior Publication Data

US 2001/0019050 A1 Sep. 6, 2001

Related U.S. Application Data

(60) Division of application No. 09/697,100, filed on Oct. 26, 2000, which is a continuation-in-part of application No. 09/395,326, filed on Sep. 13, 1999, now Pat. No. 6,160,246, which is a division of application No. 09/296,375, filed on Apr. 22, 1999, now abandoned, and a continuation-in-part of application No. 09/468,627, filed on Dec. 21, 1999, now Pat. No. 6,215,111, and a continuation-in-part of application No. 09/592,235, filed on Jun. 12, 2000.

(51) Int. Cl.[7] ..... H05B 3/54

(52) U.S. Cl. ..... 219/545; 219/529; 219/211; 219/212; 219/527; 219/549

(58) Field of Search ..... 219/545, 529, 219/211, 212, 213, 217, 527, 528, 549; 338/208; 66/61, 80, 83, 169 R, 171, 170, 182, 190, 191, 192, 193, 194, 195, 202; 29/610.1, 611, 91, 91.1

(56) References Cited

U.S. PATENT DOCUMENTS

| | | | |
|---|---|---|---|
| 975,359 | A | 11/1910 | Hefter |
| 1,553,461 | A | 9/1925 | Negromanti |
| 1,744,327 | A | 1/1930 | Moore |
| 1,965,542 | A | 7/1934 | Colvin, Jr. |
| 2,025,586 | A | 12/1935 | Hall |
| 2,203,918 | A | 6/1940 | Moberg |
| 2,381,218 | A | 8/1945 | Jacob |
| 2,392,470 | A | 1/1946 | Fitzmaurice |
| 2,432,785 | A | 12/1947 | Moberg |

(List continued on next page.)

FOREIGN PATENT DOCUMENTS

| | | |
|---|---|---|
| DE | 2 251 207 | 5/1974 |
| DE | 299 01 225 | 5/1999 |
| EP | 0 548 574 A2 | 6/1993 |
| FR | 2 740 934 | 5/1997 |

OTHER PUBLICATIONS

European Search Report Application No. 01309096.4 dated Apr. 3, 2002 (2 pages).

*Primary Examiner*—Teresa Walberg
*Assistant Examiner*—Fadi H. Dahbour
(74) *Attorney, Agent, or Firm*—Fish & Richardson P.C.

(57) ABSTRACT

A fabric article that generates heat upon application of electrical power is formed, for example, by joining stitch and loop yarns to form a fabric prebody, with the loop yarn overlaying the stitch yarn at a technical face and forming loops at a technical back of the fabric prebody. An electrical resistance heating element, e.g., in the form of a conductive yarn, is incorporated into the fabric prebody at symmetrical and/or asymmetrical spaced-apart intervals as the stitch yarn, the electrical resistance heating elements extending between opposite edge regions of the fabric and conductor elements, e.g. located along edge regions, connect the electrical resistance heating elements to a source of electrical power. The technical face and/or the technical back of the fabric body may have fleece formed by finishing in a manner to avoid damage to electrical conductance of the electrical resistance heating elements. Preferably, the conductive yarn has a core of insulating material, an electrical resistance-heating element about the core, and a sheath material surrounding the electrical resistance heating element and core.

17 Claims, 9 Drawing Sheets

U.S. PATENT DOCUMENTS

| | | | | | |
|---|---|---|---|---|---|
| 2,458,801 | A | | 1/1949 | Schwartz | |
| 2,581,212 | A | | 1/1952 | Spooner, Jr. | |
| 2,670,620 | A | | 3/1954 | Goldstaub | |
| 2,862,097 | A | | 11/1958 | Negromanti | |
| 2,945,115 | A | | 7/1960 | Weitzel | |
| 3,425,020 | A | | 1/1969 | Toyooka et al. | |
| 3,472,289 | A | * | 10/1969 | Webber et al. | 219/529 |
| 3,478,422 | A | | 11/1969 | Inui | |
| 3,513,297 | A | * | 5/1970 | Jordan | 219/545 |
| 3,528,874 | A | | 9/1970 | Spencer | |
| 3,721,799 | A | | 3/1973 | Carlstrom | |
| 3,859,506 | A | | 1/1975 | Weckstein | |
| 4,021,640 | A | | 5/1977 | Gross et al. | |
| 4,063,069 | A | | 12/1977 | Perri | |
| 4,245,149 | A | | 1/1981 | Fairlie | |
| 4,250,397 | A | | 2/1981 | Gray et al. | |
| 4,375,009 | A | | 2/1983 | Fearnside et al. | |
| 4,398,462 | A | | 8/1983 | Okano | |
| 4,459,461 | A | | 7/1984 | Spencer | |
| 4,481,881 | A | | 11/1984 | Okano | |
| 4,523,086 | A | | 6/1985 | Eilentropp | |
| 4,533,821 | A | | 8/1985 | Sato | |
| 4,538,054 | A | | 8/1985 | De la Bretoniere | |
| 4,564,745 | A | | 1/1986 | Deschenes | |
| 4,577,094 | A | | 3/1986 | Mills | |
| 4,607,154 | A | | 8/1986 | Mills | |
| 4,656,334 | A | | 4/1987 | Endo et al. | |
| 4,713,531 | A | | 12/1987 | Fennekels et al. | |
| 4,736,088 | A | | 4/1988 | Bart | |
| 4,792,662 | A | | 12/1988 | Kitagaki et al. | |
| 4,983,814 | A | | 1/1991 | Ohgushi et al. | |
| 5,073,688 | A | | 12/1991 | McCormack | |
| 5,081,341 | A | | 1/1992 | Rowe | |
| 5,298,722 | A | | 3/1994 | Tanaka | |
| 5,319,950 | A | | 6/1994 | Whitt et al. | |
| 5,321,960 | A | | 6/1994 | Whitt et al. | |
| 5,364,678 | A | | 11/1994 | Lumb et al. | |
| 5,412,181 | A | | 5/1995 | Giamati | |
| 5,422,462 | A | | 6/1995 | Kishimoto | |
| 5,484,983 | A | | 1/1996 | Roell | |
| 5,573,687 | A | | 11/1996 | Tanaka | |
| 5,582,757 | A | | 12/1996 | Kio et al. | |
| 5,679,277 | A | | 10/1997 | Niibe et al. | |
| 5,858,530 | A | | 1/1999 | McCullough, Jr. | |
| 5,918,319 | A | | 7/1999 | Baxter | |
| 5,977,517 | A | | 11/1999 | Grosjean | |
| 6,160,246 | A | | 12/2000 | Rock et al. | |

* cited by examiner

ELECTRIC HEATING/WARMING FABRIC ARTICLES

TECHNICAL FIELD

This application is a division of U.S. application Ser. No. 09/697,100, filed Oct. 26, 2000, which is a continuation-in-part of U.S. application Ser. No. 09/395,326, filed Sep. 13, 1999, now U.S. Pat. No. 6,160,246, issued Dec. 12, 2000, which is a division of U.S. application Ser. No. 09/296,375, filed Apr. 22, 1999, now abandoned, a continuation-in-part of U.S. application Ser. No. 09/468,627, filed Dec. 21, 1999, now U.S. Pat. No. 6,215,111 and a continuation-in-part of U.S. application Ser. No. 09/592,235, filed Jun. 12, 2000, now pending.

BACKGROUND

Fabric heating/warming articles are known, e.g., in the form of electric blankets, heating and warming pads and mats, heated garments, and the like. Typically, these heating/warming articles consist of a fabric body defining one or a series of envelopes or tubular passageways into which electrical resistance heating wires or elements have been inserted. In some instances, the electric resistance heating wires are integrally incorporated into the fabric body during its formation, e.g. by weaving or knitting. Relatively flexible electric resistance heating wires or elements, e.g. in the form of a core of insulating material, e.g. yarn, about which is disposed an electrical conductive element, e.g. a helically wrapped metal wire or an extruded sheath of one or more layers of conductive plastic, have been fabricated directly into the woven or knitted structure of a fabric body.

SUMMARY

According to one aspect of the invention, a method of forming a fabric article adapted to generate heat upon application of electrical power comprises the steps of: joining, in a continuous web, by a reverse plaiting circular knitting process, a stitch yarn and a loop yarn to form a fabric prebody, with the loop yarn overlaying the stitch yarn at a technical face and forming in loops at a technical back of the fabric prebody; at spaced-apart intervals during the knitting process, incorporating into the fabric prebody as the stitch yarn an electrical resistance heating element; transforming the fabric prebody into a fabric body, with the electrical resistance heating elements extending between opposite edge regions of the fabric body; finishing at least one of the technical face and the technical back of the fabric body, in a manner avoiding damage to electrical conductance of the electrical resistance heating elements, to form a fleece surface region; and providing conductor elements for connecting the electrical resistance heating elements to a source of electrical power.

Preferred embodiments of this aspect of the invention may include one or more of the following additional steps: finishing the technical face of the fabric body, in a manner to avoid damage to electrical conductance of the electrical resistance heating elements, to form a first fleece surface region, and/or finishing the technical back of the fabric body in a manner to avoid damage to electrical conductance of the electrical resistance heating elements to form a second fleece surface region; during or following the knitting process, applying, directly to the continuous web, the conductor elements for connecting the electrical resistance heating elements to a source of electrical power; incorporating into the fabric body conductive yarns comprising a core of insulating material, an electrical resistance heating element disposed generally about the core, and/or a sheath material generally surrounding the electrical resistance heating element and the core; connecting the conductor element to a source of electric power and generating heat, the source of electric power comprising alternating current or direct current, e.g. in the form of a battery, which may be mounted to the fabric article; limiting formation of loops to a central region of the fabric prebody, the central region disposed between a pair of edge regions in the fabric body, and providing the conductor elements for connecting the electrical resistance heating elements to a source of electrical power in the edge regions of the fabric body, or limiting formation of loops to a plurality of central regions of the fabric prebody, each of the plurality of central regions extending in a continuous web direction and being disposed between a pair of edge regions in the fabric body, and providing the conductive elements for connecting the electrical heating elements to a source of electrical power in the edge regions of the fabric body; separating the continuous web in a direction of the continuous web to form a plurality of discrete panels of limited width transverse to the continuous web direction, each of the discrete panels having a central region with loops disposed between edge regions with conductive elements; and severing the panels generally transverse to the continuous web direction to form discrete heating pad elements.

According to another aspect of the invention, a method of forming a fabric article adapted to generate heat upon application of electrical power comprises the steps of: knitting at least a stitch yarn to form a fabric prebody, the stitch yarn comprising an elastic yarn or fiber; at spaced-apart intervals, incorporating into the fabric prebody as the stitch yarn an electrical resistance heating element; transforming the fabric prebody into a fabric body, with the electrical resistance heating elements extending between opposite edge regions of the fabric body; and providing conductor elements for connecting the electrical resistance heating elements to a source of electrical power.

Preferred embodiments of both of these aspects of the invention may include the steps of rendering the yarns of the fabric body hydrophilic or hydrophobic.

According to still another aspect of the invention, a fabric article adapted to generate heat upon application of electrical power comprises a fabric body, incorporated into the fabric body, in the form of conductive yarn, a plurality of spaced apart electrical resistance heating elements extending generally between opposite edge regions of the fabric body, and electrical conductor elements extending generally along the opposite edge regions of the fabric body and adapted to connect the plurality of spaced apart electrical resistance heating elements to a source of electrical power.

Preferred embodiments of this aspect of the invention may include one or more of the following additional features. The electrical conductor elements are adapted for connecting the plurality of spaced-apart electrical resistance heating elements to a power source of alternating current or to a power source of direct current, e.g. a battery, which may be mounted to the fabric body. The fabric body comprises a knitted body, e.g. a reverse plaited circular knitted, or other circular knitted body (such as a double knitted body of two separate layers joined by interconnecting yarns, a single jersey knitted body, a two-end fleece knitted body, a three-end fleece knitted body, a terry knitted body, or a double loop knitted body), a warp knitted or weft knitted body, or a woven body. The fabric body comprises hydrophilic or hydrophobic material. The fabric body is formed by a stitch yarn and a loop yarn. The loop yarn overlays the stitch yarn at a technical face and forms loops at a technical back of the fabric prebody. The fabric prebody has loops formed only in a central region. The fabric body has fleece formed upon at least one, and preferably both, of the technical back and the technical face. The conductive yarn is a stitch yarn. The electrical conductor elements, at least in part, are applied as a conductive paste. Preferably, the electrical conductor elements comprise a conductive wire, or a conductive yarn or thread. The electrical conductor elements, at least in part, are applied as a conductive hot melt adhesive. The electrical conductor elements are attached upon a surface of the fabric body, e.g. by stitching, e.g. embroidery stitching, by sewing, by adhesive, by laminating, by mechanical fastening, or by strain relief fastening. The electrical conductor elements are incorporated into the fabric body, e.g. the fabric body is woven, e.g. plush woven or flat woven of coarse yarns that can be raised, and the electrical conductor elements comprise filling or warp yarns disposed at opposite edge regions of the fabric body. Preferably, the electrical conductor elements comprise at least two filling or warp yarns at each opposite edge region. The fabric body is weft or circular knit, and the electrical conductor elements comprise yarns disposed along opposite edge regions of the fabric body. Preferably, the electrical conductor elements comprise at least two yarns at each opposite edge region. The conductive yarn preferably comprises a core of insulating material, an electrical resistance heating element disposed generally about the core, and a sheath material generally surrounding the electrical resistance heating element and the core. The electrical resistance-heating element has electrical resistance in the range of about 0.1 ohm/cm to about 500 ohm/cm. In alternative embodiments of the conductive yarn, the core or the sheath material may be omitted. In a preferred embodiment, the fabric body comprises a first fabric layer and a second fabric layer, and the plurality of spaced apart electrical resistance heating/warming elements incorporated into the fabric body and the conductor elements are disposed generally between the first fabric layer and the second fabric layer. The fabric body comprises a double knit fabric body and the first fabric layer and the second fabric layer are joined, in face-to-face relationship, by interconnecting yarns, the plurality of spaced apart electrical resistance heating/warming elements incorporated into the fabric body and the conductor elements being positioned and spaced apart by the interconnecting yarns and joined by the conductors in a parallel circuit. The first fabric layer and the second fabric layer are formed separately and joined in face-to-face relationship, with the plurality of spaced apart electrical resistance heating/warming elements incorporated into the fabric body and the conductor elements disposed therebetween. The first fabric layer and the second fabric layer may be joined by laminating or by stitching. The plurality of spaced apart electrical resistance heating/warming elements and the conductor elements, arranged with symmetrical or asymmetrical spacing, are mounted upon a substrate, the substrate with the plurality of spaced apart electrical resistance heating/warming elements and the conductor elements mounted thereupon being disposed between the first fabric layer and the second fabric layer. The substrate comprises an open grid fabric or moisture resistant, vapor permeable polymeric barrier material. The plurality of spaced-apart electrical resistance heating/warming elements and the conductor elements are mounted upon at least one opposed surface of the first and second fabric layers, e.g., by stitching, e.g., embroidery stitching. The fabric article has the form of a heating pad. The knitted body is a weft or circular knitted body with stitch yarns comprising elastic yarns or fibers.

An objective of the invention is to provide electric heating/warming fabric articles, e.g. electric blankets, heating and warming pads, heated garments, etc., into which a plurality of spaced-apart electric resistance heating members, in the form of conductive yarns, are incorporated by a knitting or weaving process. The fabric body of the heating/warming article, including the incorporated electric resistance heating members, may subsequently be subjected to a fabric finishing process, e.g., one or both surfaces of the fabric body may be napped, brushed, sanded, etc., to form fleece. In a planar structure, such as an electric heating blanket, the electric resistance heating members are connected at their ends along opposite edge regions of the planar fabric body, i.e. of the blanket, and may be powered by alternating current or direct current, including by one or more batteries mounted to the blanket. The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 12 is a somewhat diagrammatic end section view of a preferred embodiment of a conductive yarn for an electric heating/warming fabric article of the invention, while

Like reference symbols in the various drawings indicate like elements.

DETAILED DESCRIPTION

Figure 1:
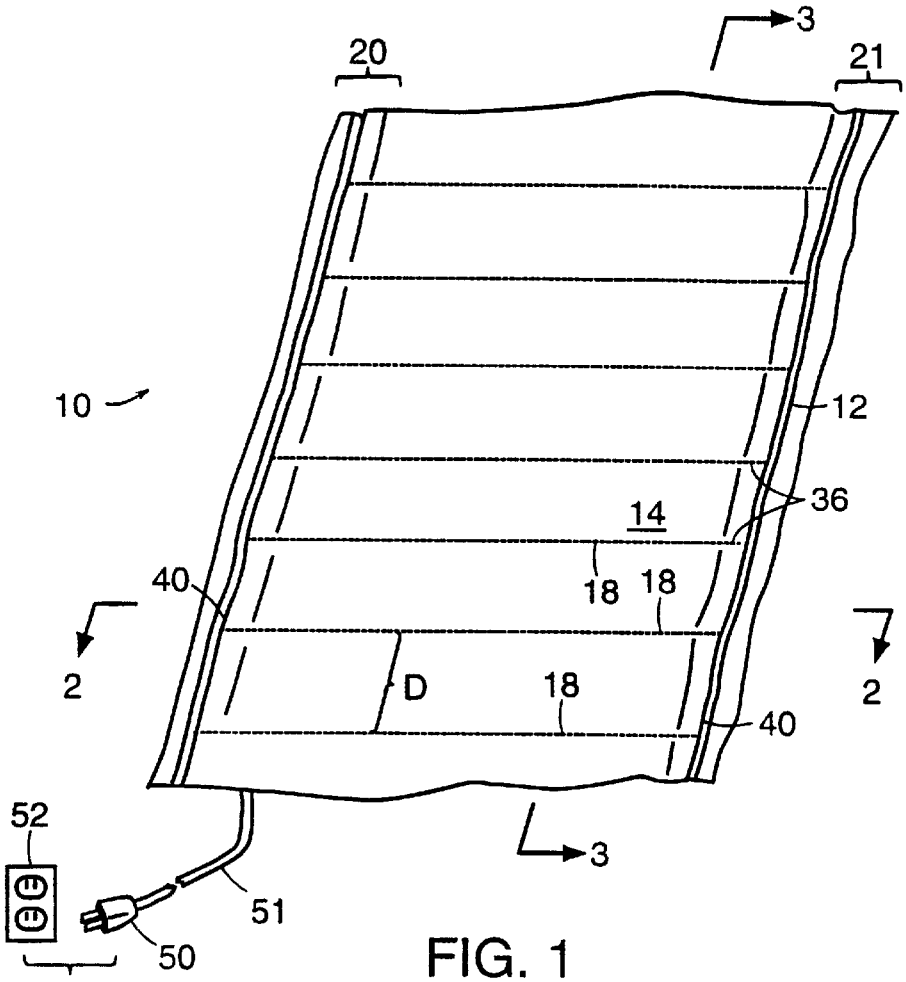
FIG. 1 is a perspective view of an electric heating/warming composite fabric article of the invention in the form of an electric blanket.
Figure 2:
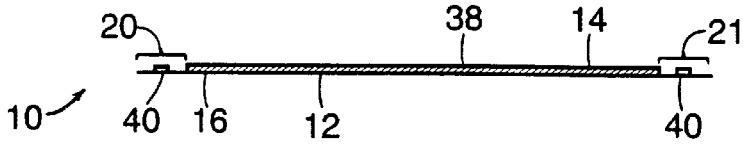
FIG. 2 is an end section view of the electric heating/warming composite fabric article of the invention, taken at the line 2—2 of FIG. 1.
Figure 3:
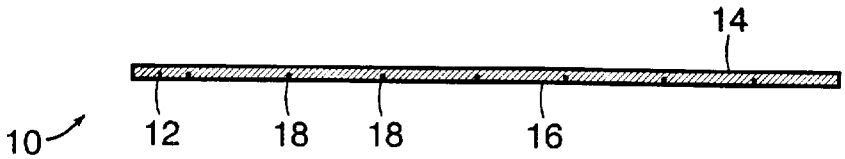
FIG. 3 is a side section view of the electric heating/warming composite fabric article of the invention, taken at the line 3—3 of FIG. 1.
Figure 4:
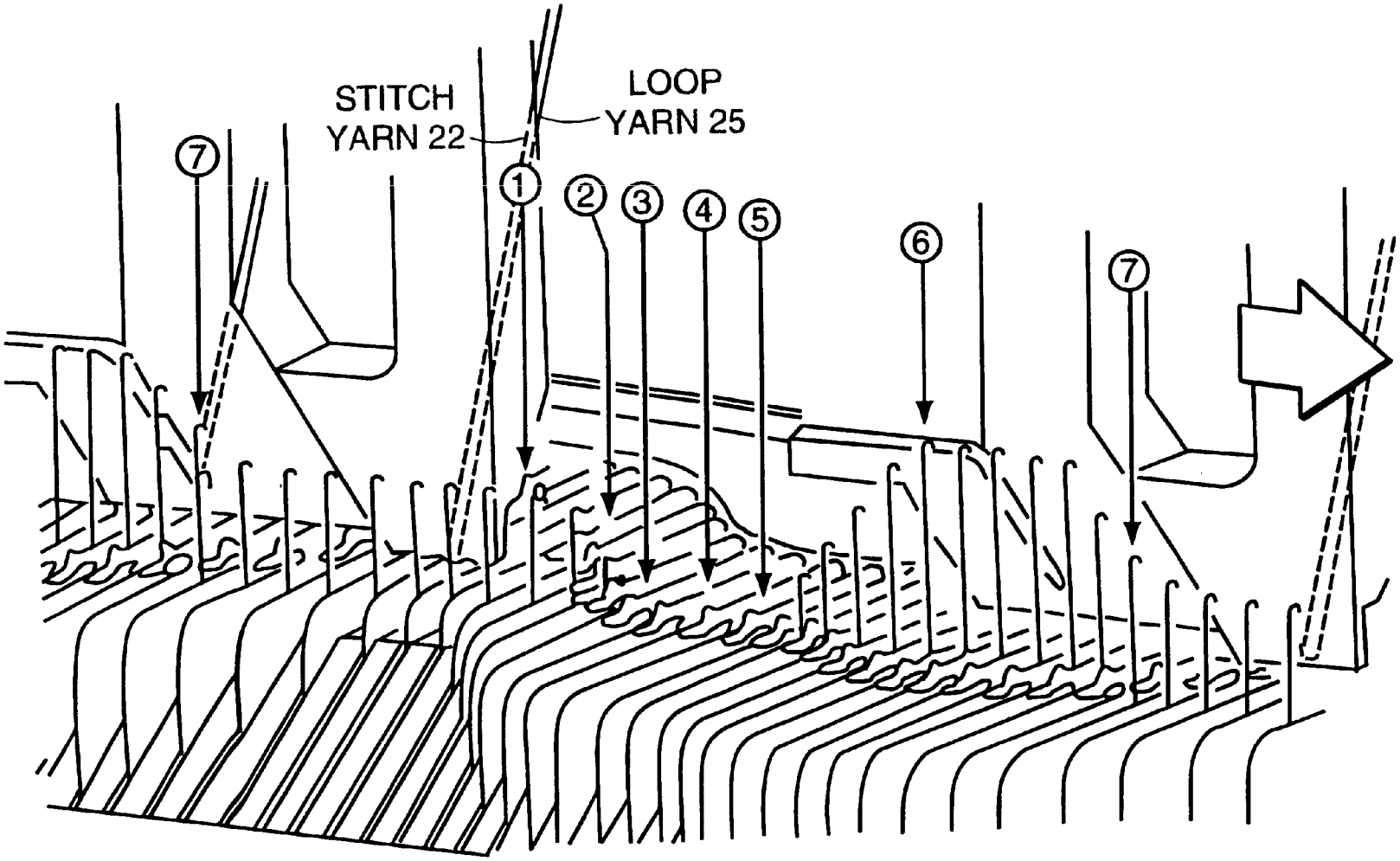
FIG. 4 is a perspective view of a segment of a circular knitting machine.
Figures 5, 6, 7, 8, 9, 10, 11:
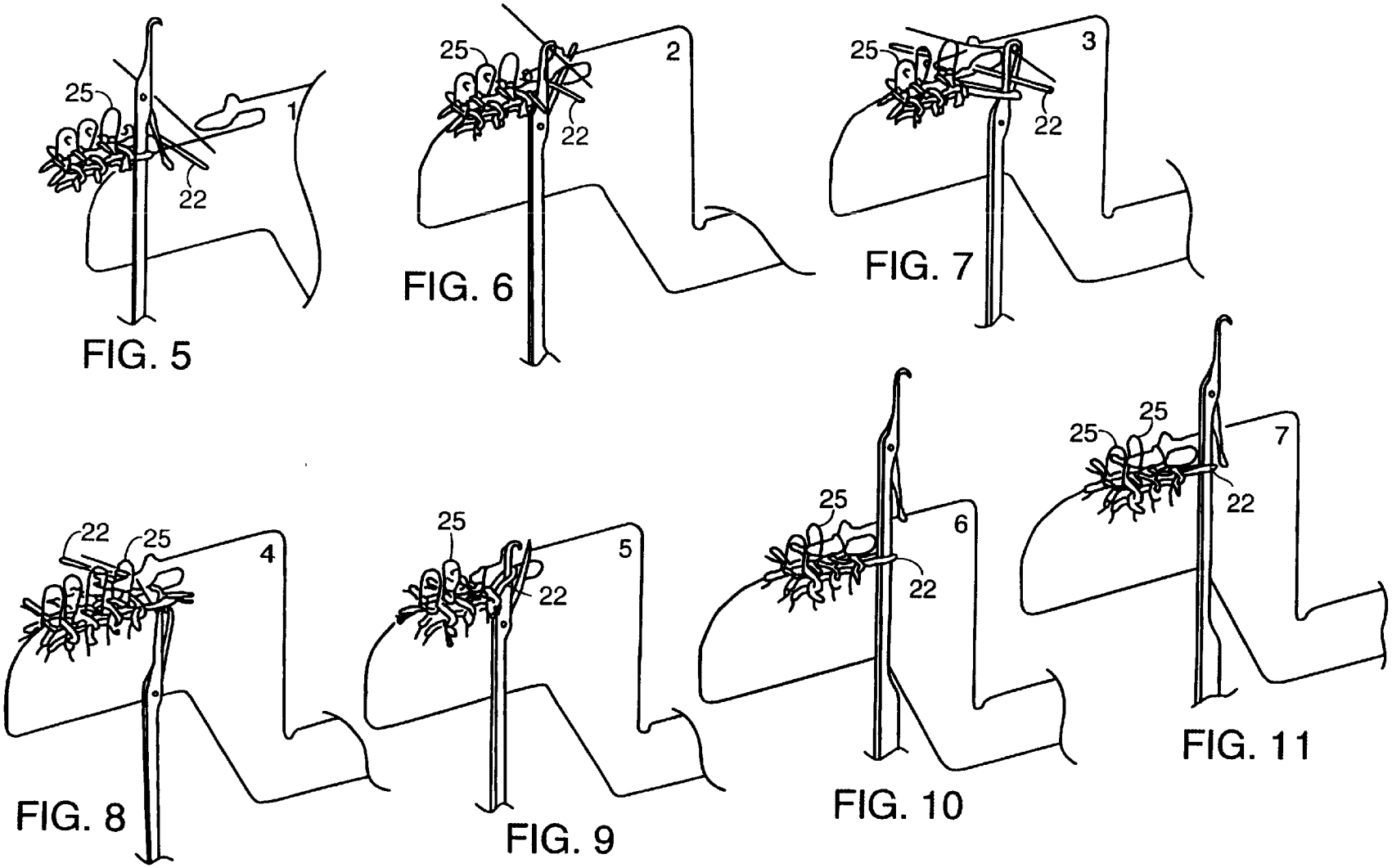
FIGS. 5–11 are sequential views of a cylinder latch needle in a reverse plaiting circular knitting process, e.g. for use in forming an electric heating/warming composite fabric article of the invention.

Referring to FIGS. 1–3, an electric heating/warming composite fabric article 10 of the invention, e.g. an electric blanket, adapted to generate heat upon application of electrical power, consists of a fabric body 12 having a technical back 14 and a technical face 16. The fabric body 12 incorporates a plurality of spaced-apart electric resistance heating elements 18 extending between opposite edge regions 20, 21 of the fabric body.

Referring also to FIGS. 4–11, in a preferred embodiment, the fabric body 12 is formed by joining a stitch yarn 22 and a loop yarn 25 in a standard reverse plaiting circular knitting (terry knitting) process, e.g. as described in *Knitting Technology,* by David J. Spencer (Woodhead Publishing Limited, 2nd edition, 1996), the entire disclosure of which is incorporated herein by reference. Referring again to FIGS. 2 and 3, in the terry knitting process, the stitch yarn 22 forms the technical face 16 of the resulting fabric body and the loop yarn 25 forms the opposite technical back 14, where it is formed into loops (25, FIG. 10) extending over the stitch yarn 22. In the fabric body 12 formed by reverse plaiting circular knitting, the loop yarn 25 extends outwardly from the planes of both surfaces and, on the technical face 16, the loop yarn 25 covers the stitch yarn 22 (e.g., see FIG. 17). As a result, during napping of the opposite fabric surfaces to form a fleece, the loop yarn 25 protects the stitch yarn 22, including the conductive yarns 26 knitted into the fabric body in the stitch yarn position.

The loop yarn 25 forming the technical back 14 of the knit fabric body 12 can be made of any synthetic or natural material. The cross section and luster of the fibers or the filament may be varied, e.g., as dictated by requirements of the intended end use. The loop yarn can be a spun yarn made by any available spinning technique, or a filament yarn made by extrusion. The loop yarn denier is typically between 40 denier to 300 denier. A preferred loop yarn is a 200/100 denier T-653 Type flat polyester filament, e.g. as available commercially from E.I. duPont de Nemours and Company, Inc., of Wilmington, Del.

The stitch yarn 22 forming the technical face 16 of the knit fabric body 12 can be also made of any type of synthetic or natural material in a spun yarn or a filament yarn. The denier is typically between 50 denier to 150 denier. A preferred yarn is a 70/34 denier filament textured polyester, e.g. as available commercially from UNIFI, Inc., of Greensboro, N.C.

Figure 12:
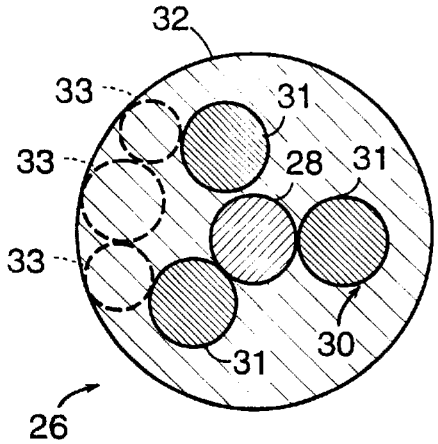

Referring now also to FIG. 12, and also to FIGS. 13–16, at predetermined, spaced, symmetrical or asymmetrical intervals during the knitting process, an electric resistance-heating member 18 in the form of a conductive yarn 26 is incorporated into the fabric body 12, e.g., in place of the stitch yarn 22. Referring to FIG. 12, in a preferred embodiment, the conductive yarn 26 forming the electrical resistance heating elements 18 consists of a core 28 of insulating material, e.g. a polyester yarn, about which extends an electrical conductive element 30, e.g. three filaments 31 of stainless steel wire (e.g. 316L stainless steel) wrapped helically about the core 28, and an outer covering 32 of insulating material, e.g. polyester yarns 33 (only a few of which are suggested in the drawings) helically wrapped about the core 28 and the filaments 31 of the electrical conductive element 30. The conductive yarn 26 is available, e.g., from Bekaert Fibre Technologies, Bekaert Corporation, of Marietta, Ga. as yarn series VN14.

Figure 15:
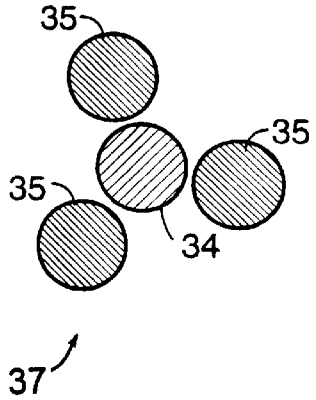
FIGS. 13–16 are similar views of alternative embodiments of conductive yarns for electric heating/warming fabric articles of the invention.
Figure 13:
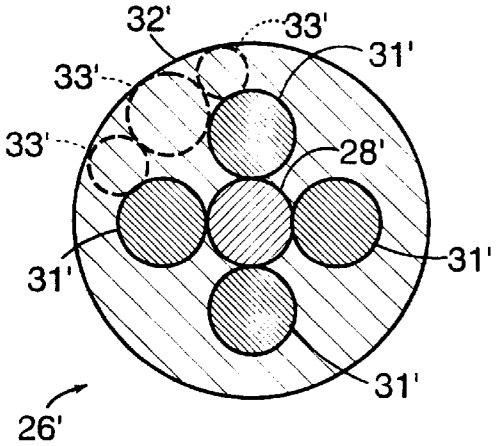
Figure 16:
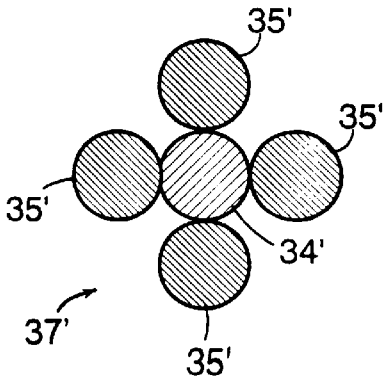
Figure 14:
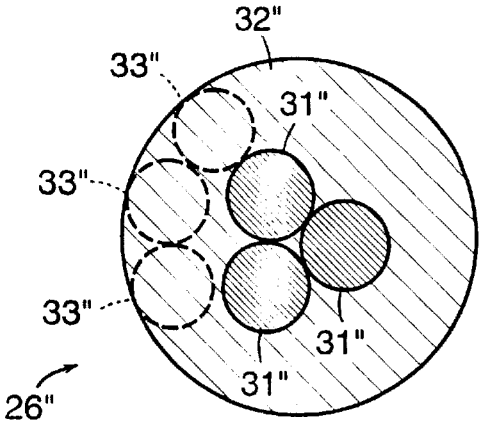

The number of conductive filaments in the conductive yarn, and the positioning of the conductive filaments within the conductive yarn, are dependent, e.g., on end use requirements. For example, in alternative configurations, in FIG. 13, a conductive yarn 26' has four filaments 31' wrapped about core 28' with an outer covering 32' of polyester yarns 33'; in FIG. 14, a conductive yarn 26" has three filaments 31" wrapped by outer covering 32" of polyester yarns 33", without a core. Referring to FIGS. 15 and 16, in other embodiments, conductive yarns 37, 37', respectively, are formed without an outer covering about the filaments 35, 35', respectively, wrapped about core 34, 34', respectively. Instead, the stitch yarn 22 and loop yarn 25 of the fabric body 12 serve to insulate the conductive yarns in the heating/warming fabric article.

The resistivity of the conductive yarn can be selected in the range, e.g., of from about 0.1 ohm/cm to about 500 ohm/cm on the basis of end use requirements of the heating/warming fabric article 10. However, conductive yarns performing outside this range can also be employed, where required or desired. The core of the conductive yarn and the sheath material of the outer covering over the conductive filaments may be made of synthetic or natural material. The outer covering may also have the form of a sleeve, e.g. a dip-coated or extruded sleeve. Conductive yarns of different constructions suitable for use according to this invention can also be obtained from Bekaert Fibre Technologies.

As mentioned above, in a preferred method of the invention, the fabric body 12 is formed by reverse plaiting on a circular knitting machine. This is principally a terry knit, where the loops formed by the loop yarn 25 cover the stitch yarn 22 on the technical face 16 (see FIG. 17). The conductive yarn is incorporated into the knit fabric prebody formed on the circular knitting machine at a predetermined spacing or distance apart, D (FIG. 1), for uniform heating in the resulting heating/warming fabric article 10. In a fabric prebody of the invention, the spacing is typically a function, e.g., of the requirements of heating, energy consumption and heat distribution in the article to be formed. For example, the spacing of conductive yarns may be in the range of from about 0.02 inch to about 2.5 inches. However, other spacing may be employed, depending on the conditions of intended or expected use, including the resistivity of the conductive yarns. The conductive yarns may be spaced symmetrically from each other, or the conductive yarns may be spaced asymmetrically, with varying spacing, as desired.

Also as mentioned above, a preferred position of the conductive yarn is in the stitch position of the circular knitted construction. The conductive yarn may then be knit symmetrically, i.e., at a predetermined distance apart, in each repeat, i.e., the conductive yarn can be in stitch position at any feed repeat of the circular knitting machine. Alternatively, the feed position may be varied, and the conductive yarns may be knit asymmetrically, with the yarns more closely or widely spaced, e.g., as desired or as appropriate to the intended product use. Again, the specific number of feeds, and the spacing of the conductive yarns, is dependent on the end use requirements. Also, in a fabric body of the invention, the power consumption for each conductive yarn is generally considerably lower than in the separate heating wires of prior art devices. As a result, the conductive yarns in a fabric body of the invention can be placed relatively more closely together, with less susceptibility to hot spots.

Figure 17:
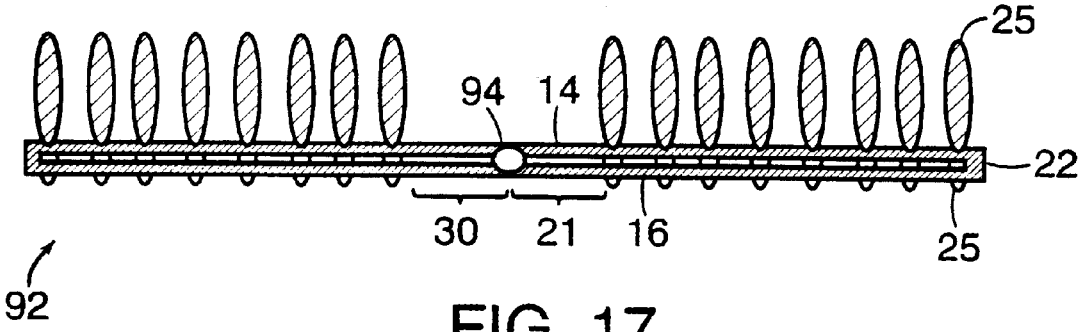
FIG. 17 is a somewhat diagrammatic section view of a segment of a tubular knit fabric during knitting.
Figure 18:
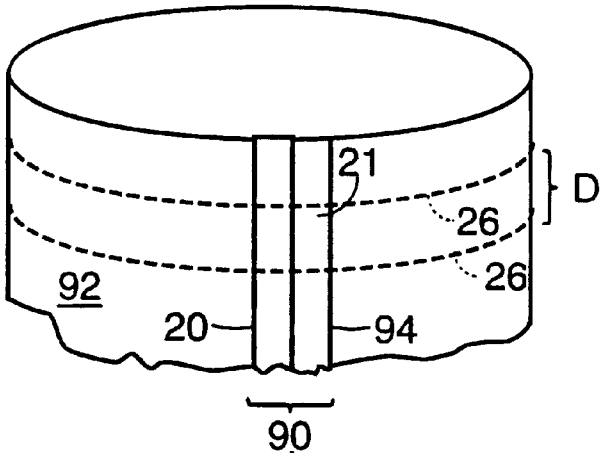
FIG. 18 is a somewhat diagrammatic perspective view of the tubular knit fabric of FIG. 17.

Referring to FIGS. 17 and 18, the edge regions 20, 21 may be formed as a panel 90 in the tubular knit body 92. The edge regions 20, 21 of the fabric body are preferably formed without loops, and in a manner such that the edge regions do not curl upon themselves, e.g. the edge region panel is formed by single lacoste or double lacoste knitting. The end portions 36 (FIG. 1) of the conductive yarns 26 extending into the flat, edge regions 20, 21 without loops are thus more easily accessible in the end regions for completing an electrical heating circuit, as described below.

The tubular knit body 92 is removed from the knitting machine and slit, e.g., along a line of stitches in a "needle-out" region 94 marking the desired slit line, to create a planar fabric. Alternatively, for increased accuracy, the tubular knit body 92 may be slit on-line, e.g. by a cutting edge mounted to the knitting machine.

Preferably, the knitted fabric body 12 incorporating the electric resistance heating elements 18 in the form of the conductive yarns is next subjected to finishing. During the finishing process, the fabric body 12 may go through processes of sanding, brushing, napping, etc., to generate a fleece 38. The fleece 38 may be formed on one face of the fabric body 12 (FIG. 2), e.g., on the technical back 14, in the loop yarn, or a fleece 38, 38' may be formed on both faces of the fabric body 12' (FIG. 19), including on the technical face 16, in the overlaying loops of the loop yarn and/or in the stitch yarn. In either case, the process of generating the fleece on the face or faces of fabric body is preferably performed in a manner to avoid damage to the conductive yarn that is part of the construction of the fabric body 12. In particular, the fleece is formed in a manner that avoids damage to the conductive filaments of the conductive yarn that would result in an increase in resistance to the point of creating an undesirable local hot spot, or would sever the conductive yarn completely, which could result in undesirable increased electrical flow elsewhere in the circuit. The fabric body may also be treated, e.g. chemically, to render the material hydrophobic or hydrophilic.

Figure 19:
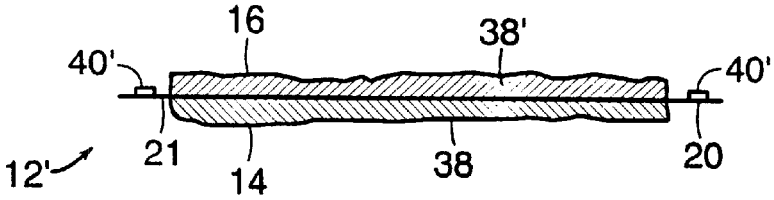
FIG. 19 is an end section view, similar to FIG. 2, of an electric heating/warming fabric article of the invention with fleece on both faces.
Figure 20:
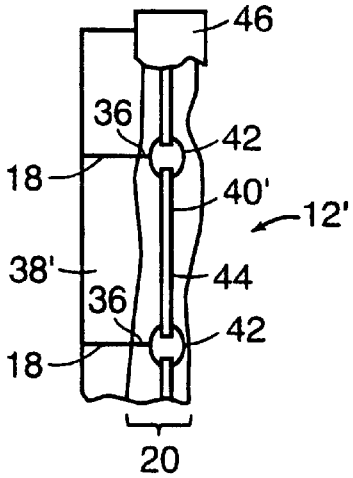
FIG. 20 is an enlarged, plan view of the technical face showing an alternative embodiment of a conductor element.

After finishing, and after the fabric body is heat set for width, conductive buses 40 are provided in opposite edge regions 20, 21 (where, preferably, there are no loops on the surface) to connect the spaced apart electrical resistance heating elements 18, in parallel, to a source of electrical power, thereby to complete the electrical circuit. The conductive buses 40 may be formed or attached upon the technical back 14, as shown in FIG. 1, or they may instead be formed or attached upon the technical face 16, as seen in FIGS. 19 and 20. Any suitable method may be used to complete the circuit. For example, referring to FIG. 1, the conductive bus 40 may, at least in part, be applied in the form of a conductive paste, e.g. such as available commercially from Loctite Corporation, of Rocky Hill, Conn. The conductive paste may be applied as a stripe to a surface of the fabric body 12 in electrical conductive relationship with the electrical resistance heating elements 18, and then connected to the power source. (If necessary, the conductive filaments of the electrical resistance heating elements 18 may be exposed, e.g., the polyester covering yarn may be removed with solvent or localized heat, e.g. by laser; the covering yarn may be manually unraveled; or the fabric body 12 may be formed with a needle out in the flat regions 20, 21, thus to facilitate accessibility to each of the conductive yarns.) More preferably, the conductive buses 40, in the form of conductive yarn or thread, are attached upon the surface of the fabric body 12, e.g., by stitching, e.g. embroidery stitching, sewing, or with an adhesive, such as by laminating. Alternatively, referring to FIG. 20, the conductive bus 40' may consist of localized dots or regions 42 of conductive paste applied in electrical contact with exposed conductive filaments of the electric resistance heating elements 18, with a conductive metal wire 44 disposed in electrical conductive contact with, and extending, preferably continuously, between, the localized conductive paste regions 42. The electric conductive bus 40' is thereafter covered by a layer of fabric material 46 joined to overlay a portion or substantially all of the surface of the fabric body 12', e.g., in the form of a cloth trim or edging material attached, e.g., by stitching along the edge of the fabric body 12', or in the form of a second layer of fabric joined to fabric body 12', e.g., by stitching or lamination.

The conductive bus 40 is preferably flexible, corrosion resistant, with low electrical resistivity, e.g. 0.1 ohm/meter to 100 ohm/meter, and mechanically durable. Other considerations include cost, availability in the market, and ease of fabrication.

The conductive bus 40 may thus have the form of a wire, e.g., stranded, twisted, or braided; a conductive-coated textile, e.g., a coated filament or fabric, or a woven ribbon; a foil tape, e.g., adhesive backed, with or without a conductive backing; a conductive-filled resin, e.g., disposed in a continuous line; or a hybrid textile, e.g., including tinsel wire or stainless steel filaments, in twisted, braided, stranded, woven or knitted configuration. The conductive bus 40 may also have the form of a single yarn, or two or more parallel yarns, woven or knitted into or stitched upon the fabric body, or a tape or band of conductive material attached upon the surface of the fabric.

In a presently preferred form, the conductive bus 40 may be a narrow woven element, incorporating silver-coated copper tinsel wire, either multi-strand or individual strands in parallel, with periodic floats provided for contact with the conductive yarns, or a narrow woven element pre-coated with conductive thermoplastic in a stripe pattern, with discontinuous diagonal stripes to provide flexibility and ensure registration with conductive yarns. The conductive bus 40 may also extend in multiple elements extending generally parallel in the edge region of the fabric, with similar or different lengths, to connect to distinct sets of conductive yarns, in this manner reducing the level of electrical current carried by each conductive bus element in the region close to the source of electrical power. In the case of conductive buses of different lengths, the resistivity of the individual conductive bus elements may be different.

The conductive bus 40 is preferably mounted upon the surface of the fabric in a manner to provide strain relief. For example, strain relief attachment may be provided by sewing the conductive bus to the fabric, by tacking the conductive bus to the fabric with mechanical fasteners, such as snaps, grommets, staples, or rivets; by over-molding in place strain relief injection-molded "buttons"; or by incorporating strain relief and electrical connection rigid filled resin having low viscosity. The conductive yarns 18 and conductive bus 40 may be connected electrically by conductive welding or paste; rivets, snaps, or metal holders or fasteners; interlacing, knitting or weaving in, or combinations of the above.

Figure 21:
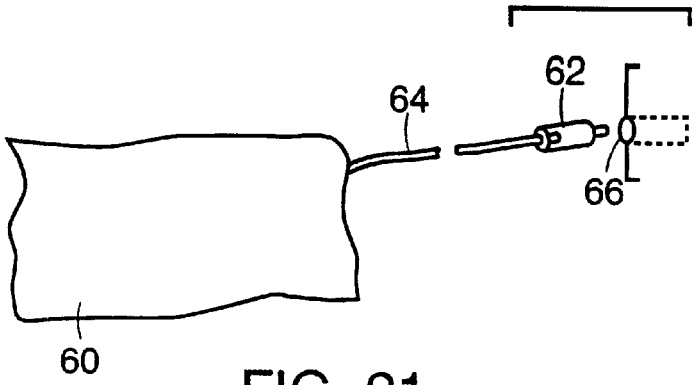
FIGS. 21, 22 and 23 are somewhat diagrammatic representations of other embodiments of heating/warming fabric articles of the invention, as adapted to be powered by direct current, e.g., an automobile warming or heating pad (FIG. 21), adapted to be powered from an automobile battery; and a stadium or camping blanket (FIG. 22) and a garment (FIG. 23), adapted to be powered from a battery replaceably mounted to the article.
Figure 23:
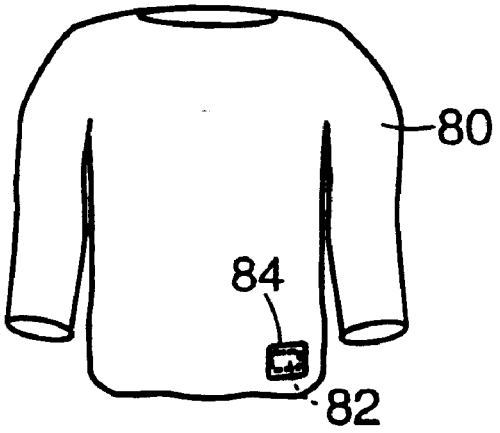
Figure 22:
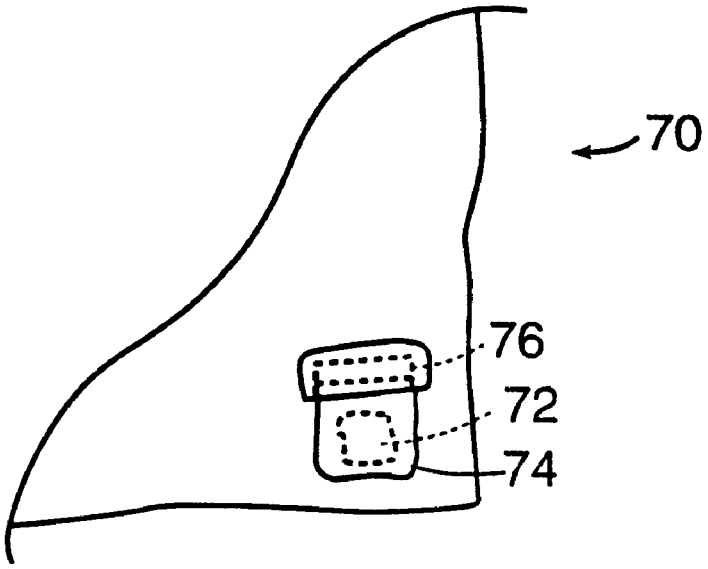

The completed circuit is next connected to a power source to supply electrical power to the electrical resistance heating elements for the required amount of heat generation. For example, referring to FIG. 1, an electric heating/warming fabric article 10 of the invention (an electric blanket) is adapted for connection to a source of alternating current by means of plug 50 on cord 51 for insertion in household outlet 52. Referring to FIG. 21, a warming or heating pad 60 of the invention, e.g. for an automobile seat, is adapted for connection to a source of direct current by means of plug 62 on cord 64 for insertion into the cigarette lighter or other power outlet 66 of an automobile. Referring to FIGS. 22 and 23, a stadium or camping blanket 70 and a garment 80 of the invention each includes a source of direct current, i.e. a battery pack 72, 82, respectively, e.g., as available from Polaroid Corporation, of Cambridge, Mass. replaceably mounted to the heating/warming fabric article, e.g. in a pocket 74, 84, respectively. Referring to FIG. 22, the pocket may be secured by a hook-and-loop type fastener 76. Preferably, for certification by Underwriters Laboratories Inc. (UL®), the voltage supplied by the power source to the electrical resistance heating elements is lower than 25 volts, e.g. a Class II UL®certified transformer may be used to step down a 110 v power supply to 25 volts or under.

Figure 29:
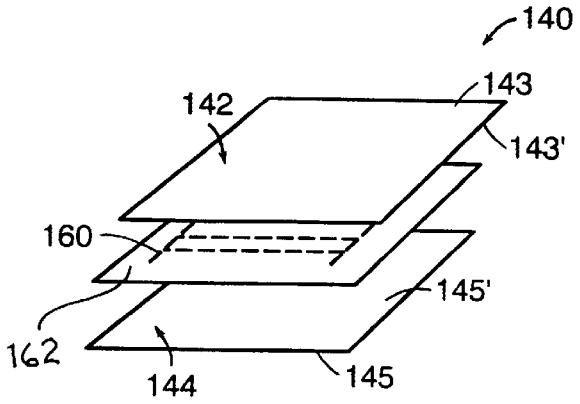
FIGS. 29 and 30 are somewhat diagrammatic perspective views of other embodiments of electric heating/warming articles of the invention formed of two or more fabric layers.
Figure 30:
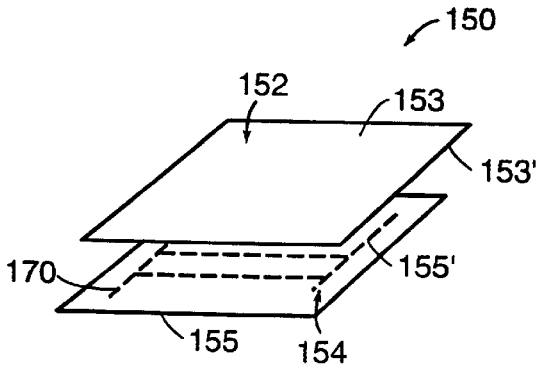

Referring to FIGS. 29 and 30, in preferred embodiments, multi-layer heating/warming fabric articles 140, 150 consist of at least two layers of fabric 142, 144 and 152, 154, respectively. Preferably, these layers of fabric have outer surfaces 143, 145 and 153, 155, respectively, one or both of which may be raised or fleece, and smooth (non-fleece), opposed inner surfaces 143', 145' and 153', 155', respectively, with a heating/warming circuit of the invention (represented by dashed lines 160, 170, respectively) disposed therebetween. In one preferred embodiment (FIG. 29), the heating/warming circuit 160 is associated, e.g., incorporated in or mounted upon, a separate heating/warming fabric article 162, with which it is laminated, or otherwise disposed and secured, e.g., by stitching, between the outer layers of fabric 142, 144. In this embodiment, the heating/warming fabric article 162 may be formed as described above, e.g. with respect to FIG. 1, with the heating/warming circuit of spaced apart (symmetrical or asymmetrical) electrical resistance heating elements, e.g., in the form of conductive yarns, incorporated into the fabric article 162 and extending between conductive buses at opposite edge regions. Alternatively, the heating warming fabric article 162 may be of the form described in our co-pending patent application U.S. Ser. No. 09/592,235, filed Jun. 12, 2000 and entitled "Electric Resistance Heating Warming Articles," the entire disclosure of which is incorporated herein by reference, with the heating/warming circuit 160 formed of conductive yarns disposed and secured upon the surface of the fabric article 162 and extending between conductive buses at opposite edge regions. For example, the conductive yarns may be fastened upon the surface, e.g., in embroidery stitches or sewing, by adhesive, or by mechanical locking.

In another embodiment (FIG. 30), the heating/warming circuit 170 may be incorporated into one layer (or both layers) of fabric 152, 154, or may be mounted upon an inner surface 153', 155' of one layer (or both layers) of fabric 152, 154, e.g., as described above with respect to FIG. 29.

The resulting product is an electric blanket, e.g., 90 inches by 90 inches with a 24volt power supply, with features not available with blankets currently on the market. In a preferred embodiment, the blanket has the characteristics of being: flexible, foldable, portable, able to be washed frequently, comfortable, with zone heating and low voltage (for increased safety).

A number of embodiments of the invention have been described. Nevertheless, it will be understood that various modifications may be made without departing from the spirit and scope of the invention. For example, any type of yarn may be employed.

Figure 24:
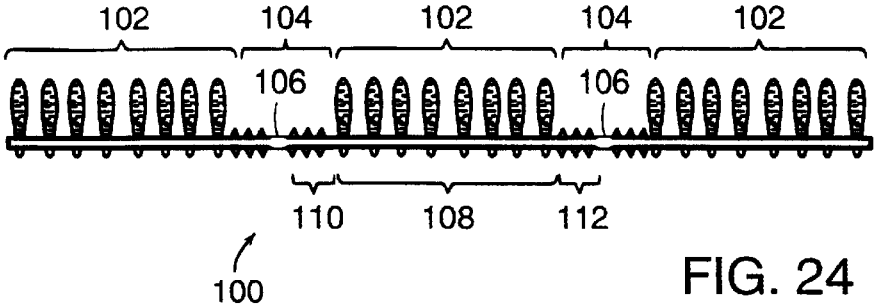
FIG. 24 is a somewhat diagrammatic sectional view of a segment of a tubular knit fabric knitted in a continuous web, to form multiple, alternating machine-direction panels or strips of regions with loops bounded by regions without loops.
Figure 25:
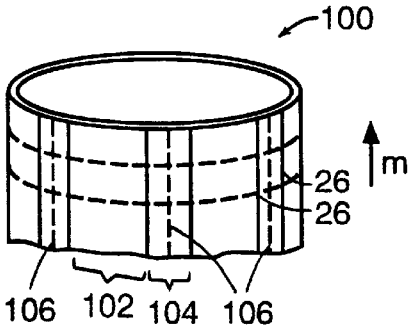
FIG. 25 is a somewhat diagrammatic perspective view of the tubular knit fabric of FIG. 24.

Also, referring to FIGS. 24 and 25, for manufacture of electric heating/warming fabric articles of narrow width, relative to the width of the knitted web, a tubular knit body 100 may be formed as a continuous web, e.g., during knitting, with multiple, alternating machine-direction (arrow, M) panels or strips of regions with loops 102 bounded along each edge by regions without loops 104. The tubular knit body 100 can removed from the knitting machine and slit, in the direction of the continuous web, along each region without loops 104, e.g. along lines of "needle-out" regions 106 marking desired slit lines, or the tubular knit body 100 can also be slit on-line, to create multiple panels of planar fabric, each panel having a central region 108 with loops bounded by opposite edge regions 110, 112 without loops. Each of the narrow panels of fabric can then be processed to form relatively narrow electric heating/warming fabric articles of the invention, e.g. personal heating pads or the like, e.g., by severing in a direction generally transverse to the continuous web direction.

Figure 26:
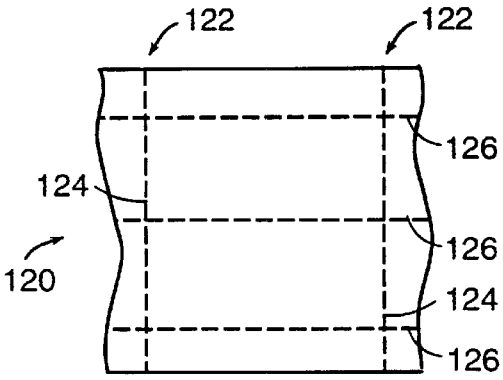
FIGS. 26 and 27 are somewhat diagrammatic plan views of segments of woven electric heating/warming fabric articles of another embodiment of the invention.
Figure 27:
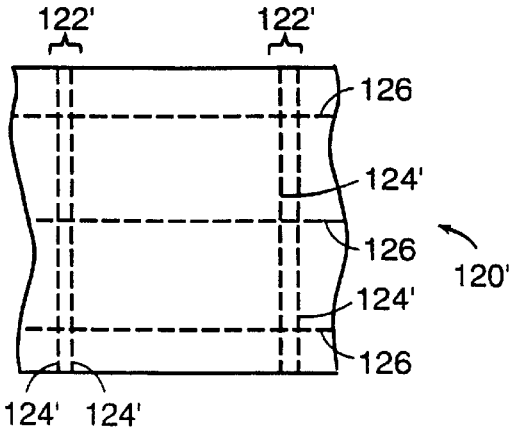

Also, other methods of constructing fabric heating/warming articles of the invention may be employed, e.g. the conductors may be incorporated by warp knit or weft knit construction or by woven construction. For example, referring to FIGS. 26 and 27, in woven electric heating/warming fabric articles 120, 120' of another embodiment of the invention, conductive bus 122, 122' may be in the position of a filling yarn or a warp yarn. The fabric body may be plush woven, i.e., formed as two sheets joined by interconnecting yarns. The sheets are then separated by cutting the interconnecting yarns, e.g., on-line, to provide two sheets, with the ends of the interconnecting yarns finished to provide each sheet with a plush surface. Alternatively, the fabric body may be flat woven of coarse yarn, which is then finished to form a raised (fleece) surface. The bus yarns may be comprised of one conductive yarn 124 (FIG. 26) with a resistivity of, e.g., 0.1 to 50 ohm per meter, or a pair of conductive yarns 124' (FIG. 27), thus to ensure a more positive connection between the electric heating/warming elements 126 and the bus yarns 122.

Figure 28:
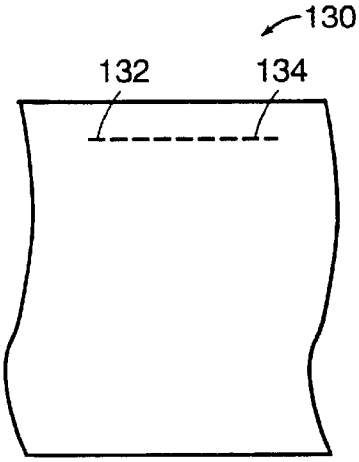
FIG. 28 is a somewhat diagrammatic plan view of a segment of a weft knit electric heating/warming fabric article of another embodiment of the invention.

Alternatively, referring to FIG. 28, in a weft or circular knit heating/warming fabric article 130 of another embodiment of the invention, the stitch yarns, including the conductive yarns 132, may include elastic yarn or fibers 134, e.g. such as spandex, e.g., with a core of elastic synthetic resin material wound with fibers of cotton, bare spandex, a spandex and yarn combination, or other suitable material, to provide a degree of elasticity or stretch. Electric heating/warming fabric articles 130 of this embodiment of the invention may have particular application for use in heating pads (where medically indicated) that can fit more closely upon irregular surfaces of a body part to be heated or warmed. The conductor element or bus may also include elastic yarn or fibers.

Referring to FIG. 29, the substrate 162 upon which the heating/warming circuit 160 is mounted or formed may be an open grid fabric, e.g. scrim, or a moisture resistant, vapor permeable and/or wind resistant barrier material. Referring to FIG. 30, the heating/warming circuit 170 may be incorporated between the fabric layers 152, 154, of a double knit fabric articles 186, with layers 182, 184 joined, in face-to face relationship, by interconnecting yarns.

Heating/warming devices of the invention may be employed for delivering therapeutic heat to a selected region of the human body. For example, for delivering therapeutic heat to a relatively large region, e.g., the back or thigh, a heating/warming device may be in the form of a wrap or sleeve, with the heating/warming circuit having the form of a parallel circuit. For delivery of heating/warming to a more local region, a heating/warming device may be in a form suitable for mounting to strap or a brace with a heating/warming circuit having the form of a series circuit.

Accordingly, other embodiments are within the following claims.

What is claimed is:

1. A method of forming a fabric article adapted to generate heat upon application of electrical power, said method comprising the steps of:

joining, in a continuous web, by a reverse plaiting circular knitting process, a stitch yarn and a loop yarn to form a fabric prebody, with the loop yarn overlaying the stitch yarn at a technical face and forming in loops at a technical back of the fabric prebody;

at spaced-apart intervals during the knitting process, incorporating into the fabric prebody as the stitch yarn an electrical resistance-heating element;

transforming the fabric prebody into a fabric body, with the electrical resistance heating elements extending between opposite edge regions of the fabric body;

finishing at least one of the technical face and the technical back of the fabric body, in a manner avoiding damage to electrical conductance of the electrical resistance heating elements, to form a fleece surface region; and providing conductor elements for connecting the electrical resistance heating elements to a source of electrical power.

2. The method of claim 1, comprising the further step of finishing at least one of said technical face and said technical back of the fabric body, in a manner avoiding damage to electrical conductance of the electrical resistance heating elements, to form a fleece surface region.

3. The method of claim 1, comprising the further steps of finishing the technical face of the fabric body, in a manner to avoid damage to electrical conductance of the electrical resistance heating elements, to form a first fleece surface region, and finishing the technical back of the fabric body in a manner to avoid damage to electrical conductance of the electrical resistance heating elements to form a second fleece surface region.

4. The method of claim 1, comprising the further step of applying, directly to the continuous web, the conductor elements for connecting the electrical resistance heating elements to a source of electrical power.

5. The method of claim 1, comprising the further step of incorporating into the fabric prebody the electrical resistance heating element in the form of a conductive yarn comprising a core of insulating material and at least one electrical resistance heating filament disposed generally about said core.

6. The method of claim 1 comprising the further step of connecting the conductor elements to a source of electric power and generating heat.

7. The method of claim 6 comprising the further step of connecting the conductor elements to a source of electric power comprising alternating current and generating heat.

8. The method of claim 6 comprising the further step of connecting the conductor elements to a source of electric power comprising direct current and generating heat.

9. The method of claim 8 comprising the further step of connecting the conductor elements to a source of electric power comprising direct current in the form of a battery and generating heat.

10. The method of claim 9 comprising the further step of connecting the conductor elements to a source of electric power comprising direct current in the form of a battery mounted to the fabric article and generating heat.

11. The method of claim 1 comprising the further steps of:

limiting formation of loops to a central region of the fabric prebody, the central region being disposed between a pair of edge regions in the fabric body, and providing the conductor elements for connecting the electrical resistance heating elements to a source of electrical power in the edge regions of the fabric body.

12. The method of claim 1 comprising the further steps of:

limiting formation of loops to a plurality of central regions of the fabric prebody, each of the plurality of central regions extending in a continuous web direction and being disposed between a pair of edge regions in the fabric body, and providing the conductive elements for connecting the electrical heating elements to a source of electrical power in the edge regions of the fabric body.

13. The method of claim 12 comprising the further step of separating the continuous web in a continuous web direction to form a plurality of discrete panels of limited width transverse to the continuous web direction, each of said discrete panels having a central region with loops disposed between edge regions with conductive elements.

14. The method of claim 13 comprising the further step of severing the panels generally transverse to the continuous web direction to form discrete heating pad elements.

15. The method of claim 1 comprising the further step of rendering the yarns of said fabric body hydrophilic.

16. The method of claim 1 comprising the further step of rendering the yarns of said fabric body hydrophobic.

17. The method of claim 1, comprising the further step of incorporating into the fabric prebody the electrical resistance heating-element in the form of a conductive yarn.

* * * * *